United States Patent [19]

Toriyama et al.

[11] Patent Number: 4,993,444

[45] Date of Patent: Feb. 19, 1991

[54] DISHWASHER

[75] Inventors: Tateo Toriyama; Masayoshi Okabe; Katsura Ikedo, all of Ota, Japan

[73] Assignee: Mitsubishi Denki Kabushiki Kaisha, Tokyo, Japan

[21] Appl. No.: 309,212

[22] Filed: Feb. 13, 1989

[30] Foreign Application Priority Data

Feb. 16, 1988 [JP] Japan ..... 63-033254

[51] Int. Cl.[5] ..... B08B 3/02

[52] U.S. Cl. ..... 134/181; 134/200; 239/752

[58] Field of Search ..... 134/172, 174, 181, 200, 134/123; 239/743, 752, 225.1

[56] References Cited

U.S. PATENT DOCUMENTS

| | | | |
|---|---|---|---|
| 1,142,083 | 6/1915 | Dodge | 134/172 |
| 1,508,495 | 9/1924 | Bacharach | 134/172 |
| 2,143,165 | 1/1939 | Olson | 134/172 |
| 2,351,342 | 6/1944 | Karlstrom | 134/172 UX |
| 2,827,064 | 3/1958 | Heinicke | 134/172 |
| 3,135,272 | 6/1964 | Brollo | 134/174 |
| 3,543,774 | 12/1970 | Trasp | 134/123 |

FOREIGN PATENT DOCUMENTS

| | | | |
|---|---|---|---|
| 59-13270 | 1/1984 | Japan . | |
| 57129563 | 8/1984 | Japan . | |
| 384418 | 12/1932 | United Kingdom | 134/172 |
| 926547 | 5/1963 | United Kingdom . | |
| 943585 | 12/1963 | United Kingdom . | |
| 990333 | 4/1964 | United Kingdom . | |
| 1076136 | 7/1967 | United Kingdom . | |

OTHER PUBLICATIONS

Search Report of U.K. Application No. 8902741.1.

*Primary Examiner*—Frankie L. Stinson

[57] ABSTRACT

In a dishwasher having a wash tank for removably installing a cage for accommodating dishes, a nozzle body with a plurality of wash water spray apertures is moved back and forth while spraying wash water through spray apertures provided therein. Preferably, the nozzle body is H-shaped and moved along a water conduit extending horizontally through the body of the dishwasher. The wash water is supplied through the conduit, into a cavity within the nozzle body and through the spray apertures.

9 Claims, 7 Drawing Sheets

DISHWASHER

BACKGROUND OF THE INVENTION

This invention concerns a dishwasher for washing dishes.

In a well-known common type of dishwasher, a wash water supply means such as a circulation pump is used, a nozzle body is rotated, and the wash water is sprayed from spray apertures in the nozzle body onto the dishes in a wash tank. FIG. 1 and FIG. 2 illustrate an example of this type of dishwasher.

As illustrated in FIG. 1 and FIG. 2, the dishwasher includes a wash tank 1 containing a cage 3 for accommodating dishes 2. A nozzle body 5 is provided in the wash tank 1 and rotates under hydraulic pressure supplied by a circulation pump 4. Wash water from a plurality of spray apertures 6 on the nozzle body is sprayed onto the cage 3, and the dishes 2 are thereby washed. Wash water that is to be used in the wash tank is first collected at the bottom of the tank 1 by a water supply device (not shown), and while being heated by a heater or other heating means (not shown), passes through a residue filter 8, returns to the circulation pump 4, and is then re-sent to the nozzle body 5.

In the conventional type of dishwasher described above, wash water is sprayed through the spray apertures while the nozzle body 5 rotates, but as shown in FIG. 2, wash water is not distributed evenly between the corners CN and the central part CP of the wash tank 1 regardless of how the angle of spray from the apertures 6 may be adjusted. Moreover, the dishes in the cage 3 may have different shapes, and as they cannot be set in the cage under the same conditions with respect to the nozzle body 5, they cannot be washed uniformly. In order to prevent this, the wash tank 1 must have a shape which is as close to a square as possible or else be circular having its center coincident with the center of rotation of the nozzle body 5, and the dishes 2 must be set at an equal distance from the center of rotation. Gaps must also be left between the dishes where the water cannot easily enter. The gaps are left, however, the space taken up by the dishes is then greater, the wash tank 1 has to be made larger, and the dishwasher cannot be made compact. Further, it was found that dishes 2 set at the corners CN were not washed clean unless the washing time was extended.

SUMMARY OF THE INVENTION

The present invention has for its purpose to resolve these problems of the prior art and to provide a dishwasher by which washing efficiency can be increased, wash time can be shortened and space can be saved.

The dishwasher according to this invention comprises a wash tank, a cage to accommodate dishes, a nozzle body having spray apertures for spraying wash water, a drive means which confers a linear back and forth motion on the nozzle body in the wash tank, and a wash water supply means for supplying wash water to the nozzle body.

In the dishwasher of this invention, the nozzle body with spray apertures for spraying wash water is moved back and forth linearly in the wash tank 1 by the drive means, and as it moves back and forth relative to the dishes accommodated in the cage, it sprays water from the water supply onto the dishes so as to wash them.

DETAILED DESCRIPTION OF THE EMBODIMENTS

An embodiment of this invention will now be described with reference to FIG. 3 through FIG. 8.

Figure 1:
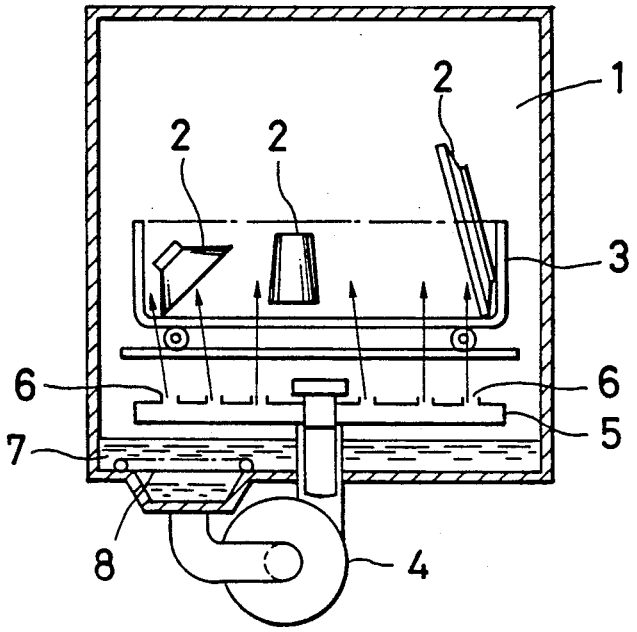
FIG. 1 PRIOR ART
FIG. 1 is a cross sectional view of a dishwasher of conventional type.
Figure 2:
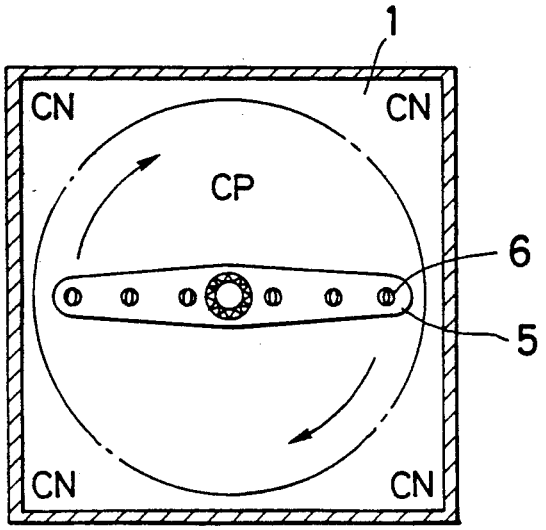
FIG. 2 PRIOR ART
FIG. 2 is a longitudinal sectional view of FIG. 1.
Figure 3:
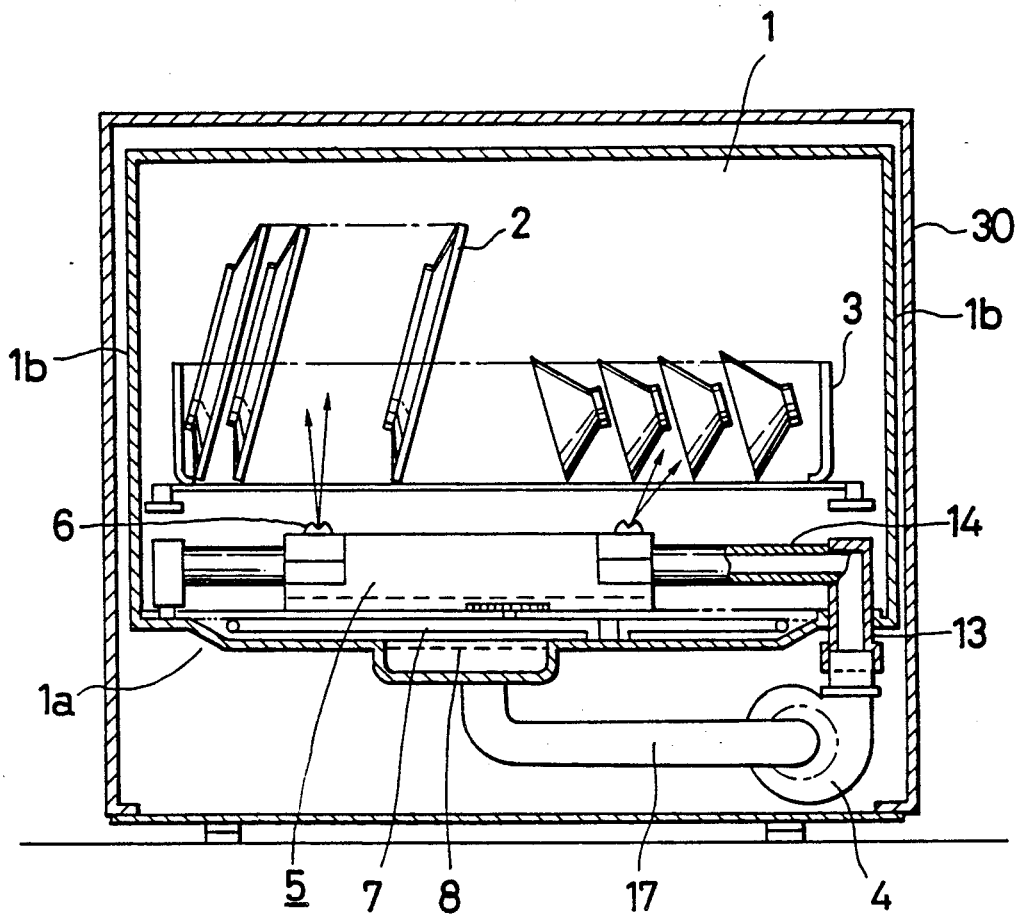
FIG. 3 is a cross sectional view showing one embodiment of the dishwasher in the present invention.
Figure 4:
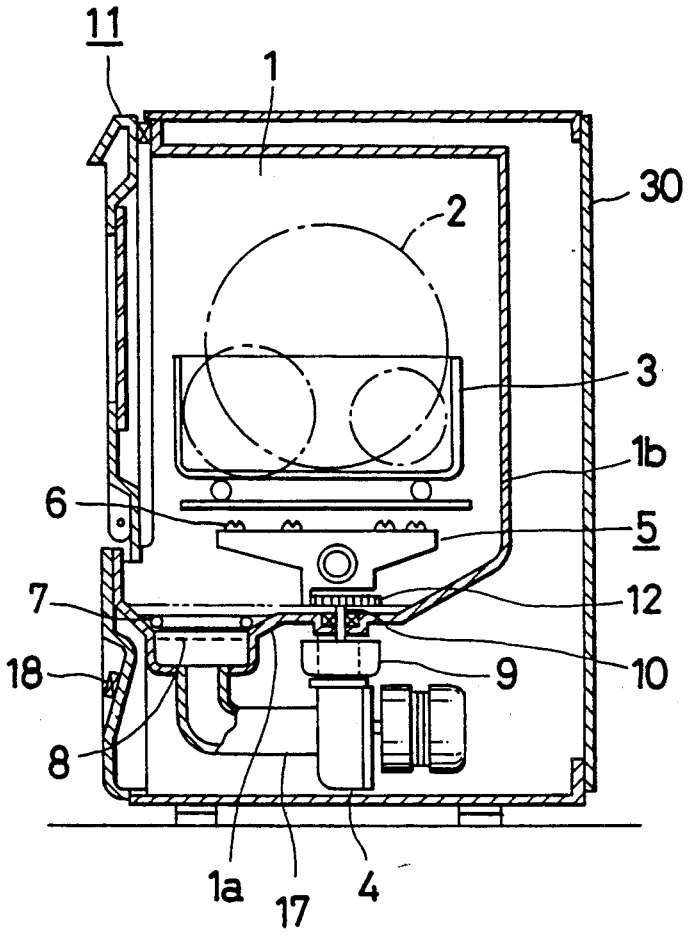
FIG. 4 is a longitudinal sectional view of the same.
Figure 5:
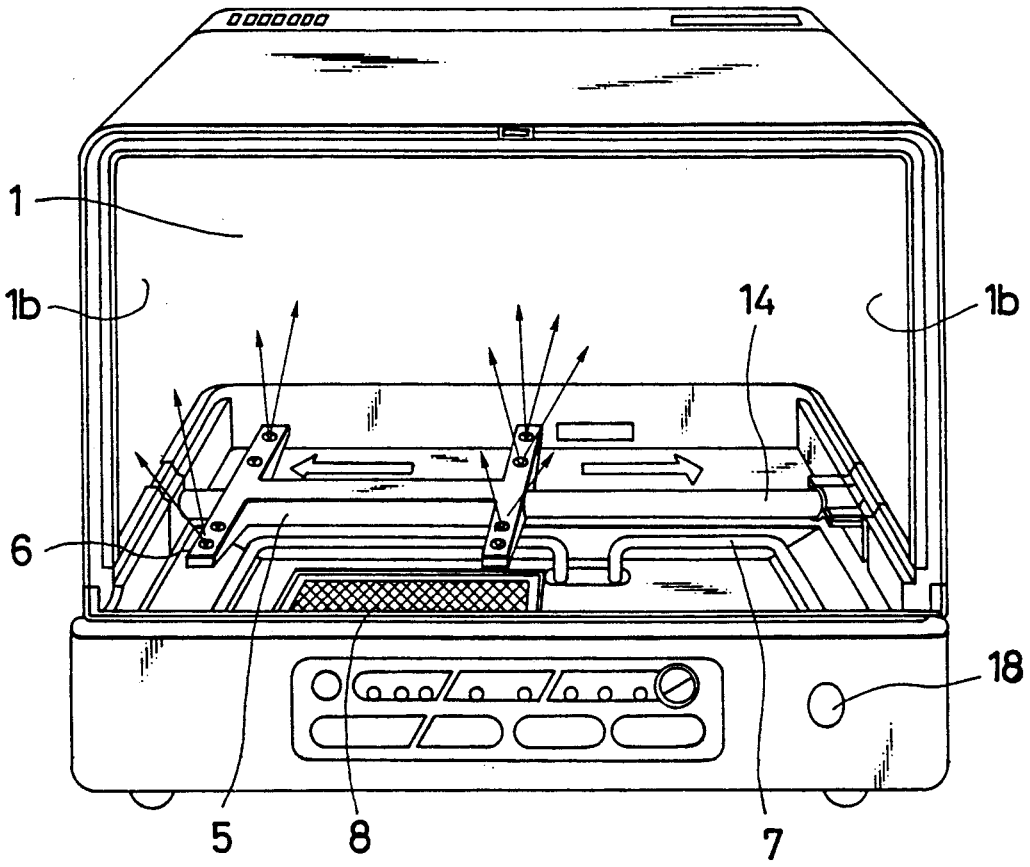
FIG. 5 is an oblique view of the dishwasher with a door and a cage removed.

As illustrated in FIG. 3 through FIG. 8, the dishwasher of this embodiment includes a wash tank 1 which has a rectangular shape with a longer lateral dimension, i.e., the dimension from left to right as seen in FIG. 5. More specifically, the wash tank 1 is formed of a bottom wall 1*a*, and four side walls 1*b*. The wash tank 1 is supported and enclosed in a main housing 30.

The wash tank 1 contains a cage 3 in such a manner that the cage 3 can be installed or removed freely. The cage 3 is for accommodating dishes 2.

A circulation pump 4 is for supplying wash water. Wash water that is supplied from a water supply (not shown) to the bottom of the wash tank 1 is supplied under pressure by the circulation pump 4 through a hose 17 to a water conduit 14.

Figure 6:
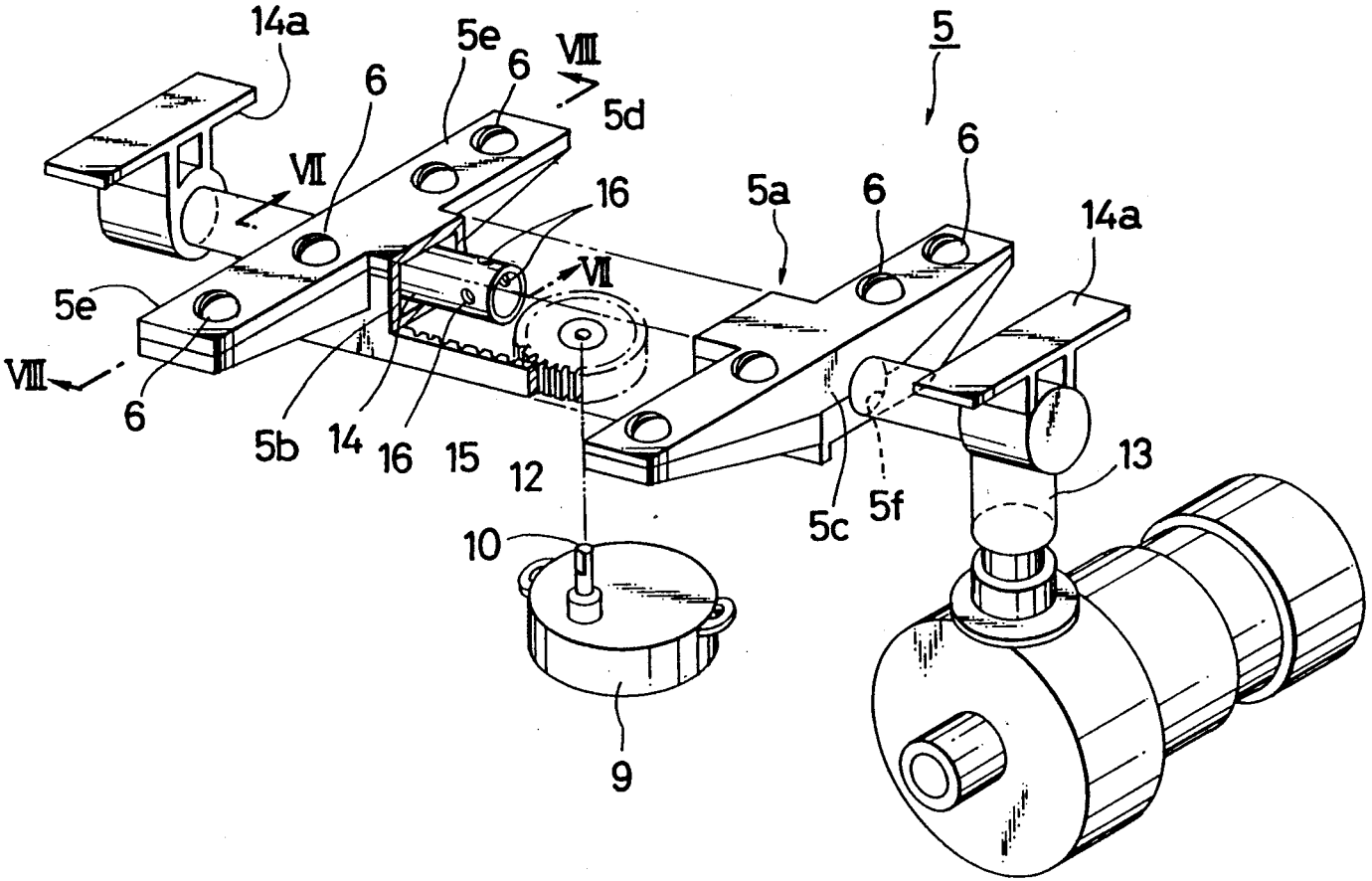
FIG. 6 is an oblique view of the drive means in the dishwasher.
Figure 7:
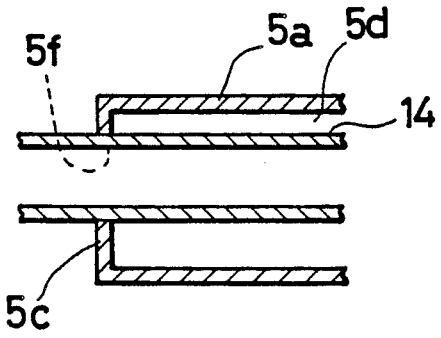
FIG. 7 is a partial sectional view along line VII—VII in FIG. 6.
Figure 8:
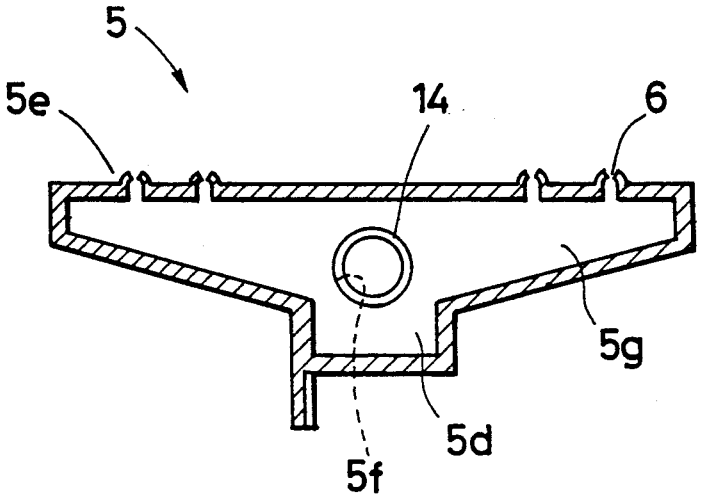
FIG. 8 is a partial sectional view along line VIII—VIII in FIG. 6.

The water conduit 14 is installed to extend horizontally in a left to right direction, as seen in FIG. 5 and FIG. 6, from one side wall to the opposite side wall, near the bottom of the wash tank 1 substantially at its center in the front to rear direction as seen in FIG. 5.

A nozzle body 5 is H-shaped and has a rectangular central part 5*a* which in the form illustrated is quandrangular-prism-shaped and has side walls 5*b* and end walls 5*c* with a cavity 5*d* formed therein. The nozzle body 5 further comprises two pairs of wings 5*e* extending laterally from the respective ends of the central part 5*a*. Each pair of wings 5*e* extend laterally and horizontally in opposite directions so that they are in line with each other. The wings 5*e* have a plurality of spray apertures 6 and a water passage 5*g* connecting the spray apertures 6 and the cavity 5*d* in the central part 5*a*. In the illustrated embodiment, the central part 5*a* and the wings 5*e* are formed integrally with each other. The end walls 5*c* have an aperture 5*f* for providing a water tight fitting with the water conduit 14 which extends through the apertures 5*f* in both end walls 5*c* and the cavity 5*d* in the central part 5*a*. In other words, the central part 5*a* extends along the water conduit 14 and is fitted over the water conduit 14 so that it is watertight. The central part 5*a* is movable along the water conduit 14 from left to right, and right to left, as seen in FIG. 5 or FIG. 6.

The end walls 5c of the central part 5a of the nozzle body 5 abuts supporting members 14a when the nozzle body reaches the extremities of its stroke along the water conduit 14. As an alternative, separate stoppers may be provided so that the nozzle body 5 abuts the stoppers when the nozzle body reaches the extremities of the stroke along the conduit. Such separate stoppers may be fixed to the side walls 1b, or the bottom wall 1a of the wash tank 1. The stopper may be part of the side walls.

The length of the central part 5a is preferably about one half the stroke of the nozzle body 5 along the conduit 14, and water delivery apertures 16 are provided substantially at the center in the longitudinal direction of the water conduit 14, so that it is always within the central part 5a of the nozzle body 5 wherever the nozzle body 5 is positioned within its stroke along the conduit 14.

The water conduit 14 is in communication with the outlet of the circulation pump 4 through a connecting tube 13. When wash water is supplied from the circulation pump 4 into the conduit 14, the wash water enters the water conduit 14, is passed through the water delivery apertures 16 into the cavity 5d in the central part 5a, through the passage 5g in the wings 5e, and is sprayed through the spray apertures 6.

A heater 7 is installed to heat wash water at the bottom of the wash tank 1. A residue filter 8 is provided to catch residue.

A motor 9 is provided with a drive shaft 10. The motor 9 is disposed outside the wash tank 1 and below the bottom wall 1a of the wash tank 1, and the drive shaft 10 projects into the wash tank 1 through a seal so that water does not leak. A pinion 12 is fitted to the drive shaft 10 of the motor 9 to engage with a rack 15 which is formed integrally with the nozzle body 5. Thus, a drive means formed of the pinion 12 and the rack 15 drives the nozzle body 5.

The motor 9 is a reversible motor of such a design that when a load or restraining force above a certain value acts on its drive shaft 10, its direction of rotation reverses. For example, the motor 9 may be a single-phase synchronous motor or a single-phase induction motor having windings for generating an alternating magnetic field (rather than a revolving magnetic field). This type of motor can rotate in either direction, and the direction of rotation depends on some accidental condition or some external force acting in either direction or obstructing the rotation in either direction.

Alternatively, the motor windings may be reconnected for changing the direction of rotation. In such a case, a separate control unit system will be required which includes for example a switch for changing the connection of the windings with the power source, a sensor, such as "microswitches" or "proximity switches", for detecting the arrival of the nozzle body 5 at the respective ends of its stroke, and a controller responsive to sensors for controlling the switches. As an alternative to the above-mentioned sensor, an over-current detector for detecting over-current due to abutment of the nozzle body to the stoppers at both ends of the stroke may be provided.

An door 11 is provided for permitting loading and unloading of the cage 3 into or out of the wash tank 1. The door 11 is closed while the washing is effected.

A power switch 18 as well as other switches are installed on the lower part of the front of the housing 30.

The operation of the dishwasher of the above embodiment is as follows. Firstly, the cage 3 accommodating dishes 2 is loaded in the wash tank 1, and the door 11 is closed. When the power switch 18 is turned on, water is supplied to the tank 1 from the water supply means (not shown). After a certain amount of water has been supplied, an electric current is supplied to the heater 7 to heat the wash water, and the circulation pump 4 and the motor 9 are activated. When the circulation pump 4 is activated, wash water collected at the bottom of the wash tank 1 passes through the residue filter 8, through the hose 17 and the pump 4, and is delivered under pressure to the water conduit 14 through the connecting tube 13. The wash water that is pressure-delivered to the water conduit 14 is supplied from the delivery apertures 16 in the central part of the conduit 14 to the nozzle body 5, and is then sprayed from the spray apertures 6 in the nozzle body 5 onto the dishes 2 in the cage 3 so as to wash the dishes.

When the motor 9 which is activated together with the pump 4 rotates, the pinion 12 fitted to its drive shaft 10 also rotates. As this pinion 12 is engaged with the rack 15 provided on the nozzle body 5, the rotation of the motor 9 causes linear movement of the nozzle body 5 along the water conduit 14 in the wash tank 1.

When the nozzle body 5 touches one of the support members 14a, the movement is stopped, the direction of rotation of the motor 9 reverses under the restraining force, and the nozzle body 5 moves linearly in the opposite direction. The nozzle body 5 therefore executes a linear back and forth motion in the wash tank 1 as wash water is sprayed uniformly from the spray apertures 6, and the dishes 2 are thereby washed. Wash water is thus sprayed uniformly into the corners even if the wash tank 1 has a rectangular shape with a large difference between its vertical and horizontal dimensions, washing efficiency is increased, and washing is completed in a shorter time. Further, since the nozzle body 5 is of such a construction that it can move back and forth, there are no severe restrictions on the shape of the wash tank 1, and the wash tank can also be made compact.

Figure 9:
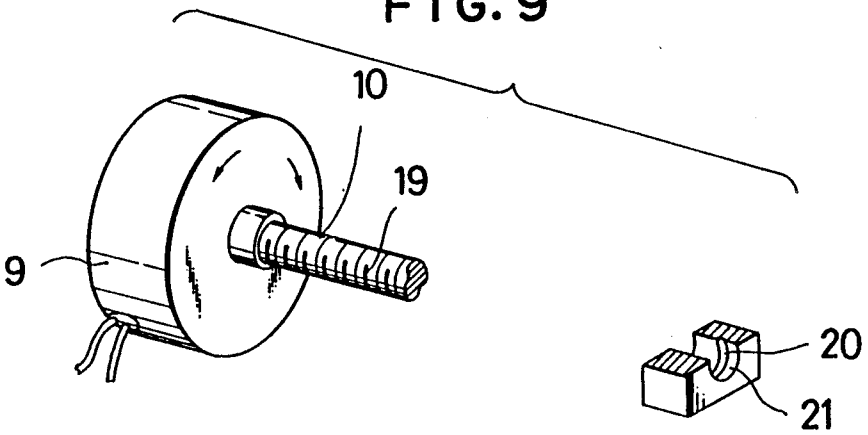
FIG. 9 is an oblique view showing another embodiment of the drive means of the present invention.
Figure 10B:
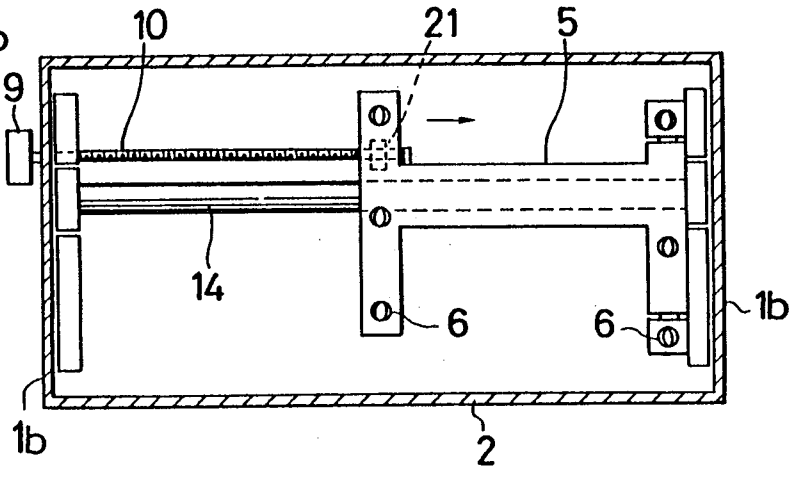
FIG. 10A and FIG. 10B sectional views, respectively showing the nozzle body moved to the left, and the nozzle body moved to the right.
Figure 10A:
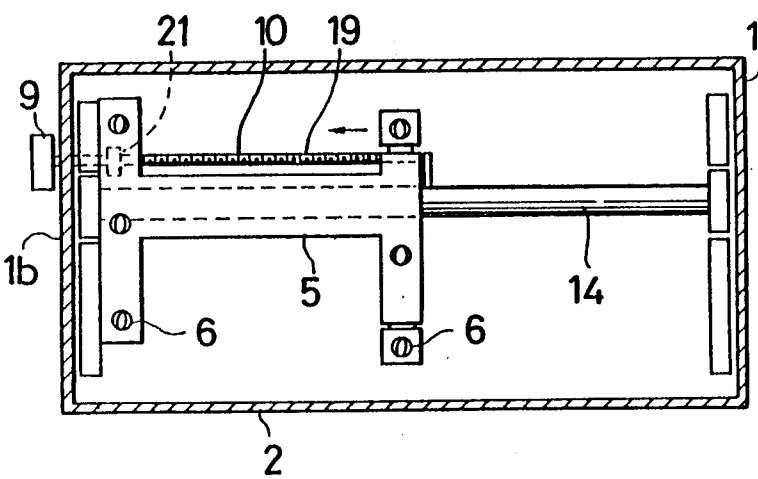

FIG. 9 is an oblique view showing another embodiment of the drive means. FIG. 10A and FIG. 10B are partial sectional views showing in particular the positions of the nozzle body in different states. In this embodiment, the motor is disposed outside the wash tank 1 and adjacent one of the side walls 1b. The motor drive shaft 10 extends through one of the side walls 1b and has a spiral groove (or projection) 19 on its outer surface. The nozzle body 5, shown to have a slightly different configuration from the nozzle body 5 of the embodiment of FIG. 3 to FIG. 7, is provided with a part having a through-hole 21 with a spiral projection (or groove) 20 on its inner wall. The drive means the spiral groove (or projection) 19, and the spiral projection (or groove) 20 on the through-hole 21 which mates with or engages with the spiral groove (or projection) 19 on the motor drive shaft 10. As in the embodiment shown in FIG. 3 to FIG. 8, the nozzle body 5 executes a linear back and forth motion over the outer wall of the water conduit 14, and the same effect is obtained.

In the embodiment illustrated, the central part 5a of the nozzle body is quadrangular-prism-shaped. Alternatively, it can be circular-cylinder-shaped.

In this invention, the nozzle body which sprays wash water is given a linear back and forth motion in the wash tank. Water can therefore be sprayed evenly on the dishes in the cage even in the corners, spraying efficiency is increased, and the time required for the washing can be shortened. Moreover, there is no need for the wash tank to be nearly circular or square as in the conventional system with a rotating nozzle, and as the same effect is obtained even with a rectangular tank with their length and width being widely different from each other, wash tank space can be used effectively.

What is claimed is:

1. A dishwasher comprising:

a wash tank, wherein said wash tank is formed of a bottom wall, and side walls;

a cage removably installed in said wash tank for accommodating dishes;

an "H" shaped nozzle body for delivering wash water to the interior of said wash tank;

said nozzle body including a rectangular central part having side walls, end walls at both ends and a cavity formed therein, and wings extending laterally from each of the opposing ends of the central part, said wings including spray apertures and a hollow water passage connecting the wings to the central part whereby said spray apertures are in communication with the cavity of said nozzle body;

drive means for applying a linear back and forth motion to said nozzle body in the wash tank;

wash water supply means for supplying the wash water to said nozzle body;

a water conduit extending horizontally in said wash tank from one of said side walls to an opposing side wall;

said end walls of the central part including an aperture for water tight fitting with said water conduit so that said water conduit extends through the apertures in the end walls of the central part and through the cavity;

said nozzle body being movable along the water conduit for said back and forth movement;

said water conduit having a plurality of water delivery apertures disposed at about the center of the water conduit in a lengthwise direction thereof so that the water delivery apertures are kept inside the cavity of the central part wherever the central part is situated along the water conduit; and means for supplying wash water into the conduit so that the wash water entering the water conduit is passed through the water delivery aperture into the cavity in the central part, through the passage in the wings, and sprayed through the spray apertures.

2. A dishwasher according to claim 1, wherein said drive means comprises:

a motor having a motor drive shaft;

a rack provided on the nozzle body; and a pinion fitted to the motor drive shaft and engaging with said rack.

3. A dishwasher according to claim 2, wherein the motor of said drive means is disposed outside of the wash tank and below the bottom wall, and the motor drive shaft extends through the bottom wall of the wash tank.

4. A dishwasher according to claim 1, wherein the nozzle body is provided with a part having a through-hole with a spiral projection or groove on its inner wall; and the drive means comprises:

a motor having a motor drive shaft with a spiral groove or projection on its outer wall that mates with the spiral projection or groove on the through-hole of the nozzle; and said through-hole is provided in the nozzle body.

5. A dishwasher according to claim 4, wherein the motor of said drive means is disposed outside of the wash tank and adjacent one of the side walls, and the motor drive shaft extends through said one of the side walls of the wash tank.

6. A dishwasher according to claim 1, wherein the length of the central part is about one half the length of the water conduit.

7. A dishwasher according to claim 1, wherein there are provided two pairs of said wings extending laterally from the respective ends in the opposite direction so that each pair of the wings extending in the opposite direction are substantially in line with each other.

8. A dishwasher according to claim 1, wherein said nozzle body has a part which is provided at or near the ends of said cylindrical part and which abuts stoppers, and wherein said motor is a reversible motor of such a design that when a load above a certain value acts on its drive shaft, its direction of rotation reverses.

9. A dishwasher according to claim 8, wherein said motor is a single-phase synchronous motor or a single-phase induction motor having windings for generating an alternating magnetic field.

* * * * *